US010942011B1

(12) United States Patent
Zea

(10) Patent No.: US 10,942,011 B1
(45) Date of Patent: Mar. 9, 2021

(54) ACTIVE SHOOTER SHIELD SYSTEM

(71) Applicant: Jaysen Zea, Smyrna, GA (US)

(72) Inventor: Jaysen Zea, Smyrna, GA (US)

( * ) Notice: Subject to any disclaimer, the term of this patent is extended or adjusted under 35 U.S.C. 154(b) by 0 days.

(21) Appl. No.: 16/735,976

(22) Filed: Jan. 7, 2020

(51) Int. Cl.

| | |
|---|---|
| ***F41H 5/06*** | (2006.01) |
| ***E06B 9/80*** | (2006.01) |
| ***F41H 13/00*** | (2006.01) |
| ***F41H 9/08*** | (2006.01) |
| *F41H 5/04* | (2006.01) |

(52) U.S. Cl.
CPC ..... *F41H 5/06* (2013.01); *E06B 9/80* (2013.01); *F41H 9/08* (2013.01); *F41H 13/0081* (2013.01); *F41H 13/0087* (2013.01); *E06B 2009/801* (2013.01); *F41H 5/0471* (2013.01)

(58) Field of Classification Search
CPC . F41H 5/06; F41H 5/0471; F41H 9/08; F41H 13/0081; F41H 13/0087; E06B 9/80; E06B 2009/801
USPC ..... 89/36.04
See application file for complete search history.

(56) References Cited

U.S. PATENT DOCUMENTS

| | | | | |
|---|---|---|---|---|
| 10,202,803 | B2 * | 2/2019 | Hsieh | F16D 65/22 |
| 10,544,624 | B2 * | 1/2020 | Baker | E05B 65/0021 |
| 10,801,815 | B2 * | 10/2020 | Adrain | E06B 9/68 |
| 2012/0060436 | A1 * | 3/2012 | Zimmer, II | F41H 5/22 52/202 |
| 2013/0074409 | A1 * | 3/2013 | Hsieh | E06B 9/80 49/139 |
| 2017/0328130 | A1 * | 11/2017 | Baker | G07C 9/00309 |
| 2019/0309566 | A1 * | 10/2019 | Rush | G09F 7/22 |

* cited by examiner

*Primary Examiner* — Samir Abdosh
(74) *Attorney, Agent, or Firm* — Clayton, McKay & Bailey, PC

(57) ABSTRACT

Examples herein describe systems and methods for securing an opening and disorienting an active shooter. A command device can send a deployment command to a zone in a building. In response, canopies in the zone can deploy a roll-up door made of Kevlar that electromagnetically locks shut. The canopies can include blindingly bright lights and deafening sirens that disorient the shooter. The doors can block off rooms or other areas of a school where children can huddle safely until the shooter is apprehended. Canopies without doors can also be used at some openings to disorient the shooter.

19 Claims, 5 Drawing Sheets

ACTIVE SHOOTER SHIELD SYSTEM

BACKGROUND

Incidents of mass shootings are on the rise. Schools, mosques, churches, and even concert venues have become the loci of horrendous crimes against humanity. School shooters are increasingly emboldened, with Columbine copycats causing incalculable harm and putting the public in a constant state of panic. In fact, many children these days learn active shooter drills prior to learning to read. School resource officers are vastly unequipped to handle heavy-artillery-wielding madmen who can enter virtually any school unannounced and begin spraying bullets. Similarly, when such a shooter enters a residential, religious, or commercial building, it is very difficult to kill the shooter before he or she kills numerous innocent people. Hired guards and mall cops are often unequipped to neutralize the threat. Even when police arrive on the scene, law enforcement officers often must begin the harrowing task of tracking the shooter down—typically by listening for screams and gunfire. Although most of these monsters eventually kill themselves or get killed by police, it would be better for them to do so without putting everyone else at such high risk—particularly children.

To that end, there currently is no way to easily disorient or detain a shooter in a school, home, religious site, or commercial setting. Instead, the shooters typically roam around and just keep firing until they run out of ammo or another gun-wielding citizen takes them out. A normal door barely even slows down these predators. A shooter will simply blast through it, kick it down, and massacre whoever happens to be cowering inside. Then the shooter may keep moving toward any fearful cries, firing at everything that moves. There currently exists no simple approach to shielding potential victims, disorienting the shooters, or detaining the shooters until authorities arrive.

Therefore, a need exists for a system that can safely shield potential victims from gunfire while detaining or completely disorienting an active shooter.

SUMMARY

Examples described herein include systems and methods for shielding people from an active shooter. The shield system can include a canopy that hangs over an opening, such as a hallway, window frame, or door opening. The shield system can be used on any opening that is inside or outside of any type of structure. The canopy can include various devices for disorienting the shooter. In one example, the canopy can house a roll-up door that closes off the opening upon deployment. In another example, the canopy can be installed without a roll-up door. The canopy can be sized to fit the opening when a roll-up door is included. Otherwise, the canopy can be any size.

The canopy can include a light-emitting diode ("LED") having a brightness of at least 3000 lumens. The LED can be one or more bulbs or a strip of LEDs that achieves the minimum brightness. This brightness level can blind or partially blind an active shooter.

The canopy can also include a siren that emits noise at a loudness of at least 126 decibels. The siren can emit a blaring noise that deafens or disorients the shooter in an example. Alternatively, the siren can blast a loud message that plays at deafening levels. The combination of the blinding light and deafening sound can disorient the active shooter.

The canopy can include a roll-up door that deploys from the canopy, in an example. The roll-up door can be at least partially made of a sheet of Kevlar in an example. The Kevlar can unroll to the floor upon deployment, blocking the opening (e.g., hall or door opening). The door can be locked into place with an electromagnetic lock. The electromagnetic lock can include one or more electromagnets that activate during deployment. The electromagnetic lock can exist at one or more locations, such as embedded into the floor or incorporated into a guide track of the roll-up door. A metal portion of the roll-up door can be attracted to the electromagnetism and prevent the door from opening while the electromagnetic lock is active.

The canopy can also include a controller that causes various events to occur in response to a deployment command. The deployment command can be detected based on any deployment condition, such as a detection of a gunshot or a command received from a command center. In one example, the deployment command causes the controller to issue a signal to an electric motor that deploys the roll-up door. The door can deploy down guide rails until it reaches the floor. Then, it can lock electromagnetically. However, in some examples, the canopy does not contain a door.

The deployment can also include activating the LED and the siren. Both of these can create a condition that is difficult for an active shooter. The blinding light can make aiming very difficult or even impossible. Similarly, the deafening noise can prevent the shooter from accurately detecting the movements and screams of his potential victims, making it more difficult for the shooter to track down those who may be fleeing the scene or attempting to hide.

The canopy can include additional devices that also activate during deployment, in an example. For example, one or more cameras can activate, and the controller can send a live feed for display in a control room or on devices maintained by authorities. For example, a laptop with a shield application can receive and display feeds from multiple cameras at multiple different canopies. This can allow law enforcement to track the shooter's location and see where a great need for intervention exists.

The canopy can also include a smoke sprayer (i.e., smoke sprinkler assembly) that begins spraying smoke during deployment. The smoke can be created using prefabricated smoke cartridges or liquid fog droplets, such as by pumping a glycol and water mixture across a heating element. Preloaded smoke powder can also be used in an example. The smoke can further limit the shooter's vision.

The canopy can also include a sprinkler that begins spraying water during deployment. The sprinkler can be hooked into a plumbing system or can use a water reservoir that is housed in the canopy. The water can decrease risk of fire. This can be especially useful in a situation where the canopy deploys and locks the roll-up door.

The canopy can also activate a two-way speaker. This can allow authorities to hear in proximity to the canopy when the siren is deactivated by remote control. Authorities can also talk to civilians or a nearby shooter.

Both the foregoing general description and the following detailed description are exemplary and explanatory only and are not restrictive of the examples, as claimed.

DESCRIPTION OF THE EXAMPLES

Reference will now be made in detail to the present examples, including examples illustrated in the accompanying drawings. Wherever possible, the same reference numbers will be used throughout the drawings to refer to the same or like parts.

In an example, an active shooter shield system can include a canopy with various disorienting visual and auditory features. The canopy can also house a roll-up door in an example. The canopy can be placed above an opening, such as a hallway or doorway. Multiple such canopies can be installed inside a building, such as a school. The canopies can be assigned to zones to allow for area-based deployment of canopies in the same zone at the same time.

Based on a deployment command, the canopy can subject a shooter to blinding light, deafening sound, and other disorienting maladies. This can help reduce the shooter's ability to track and accurately shoot would-be victims. Additionally, in one example, the canopy can deploy a roll-up door made of Kevlar. This can prevent the shooter from firing through the door and allow for blocking off areas, such as classrooms. When a zone is deployed, multiple roll-up doors can close, trapping the shooter within a foyer or hallway.

Figure 1:
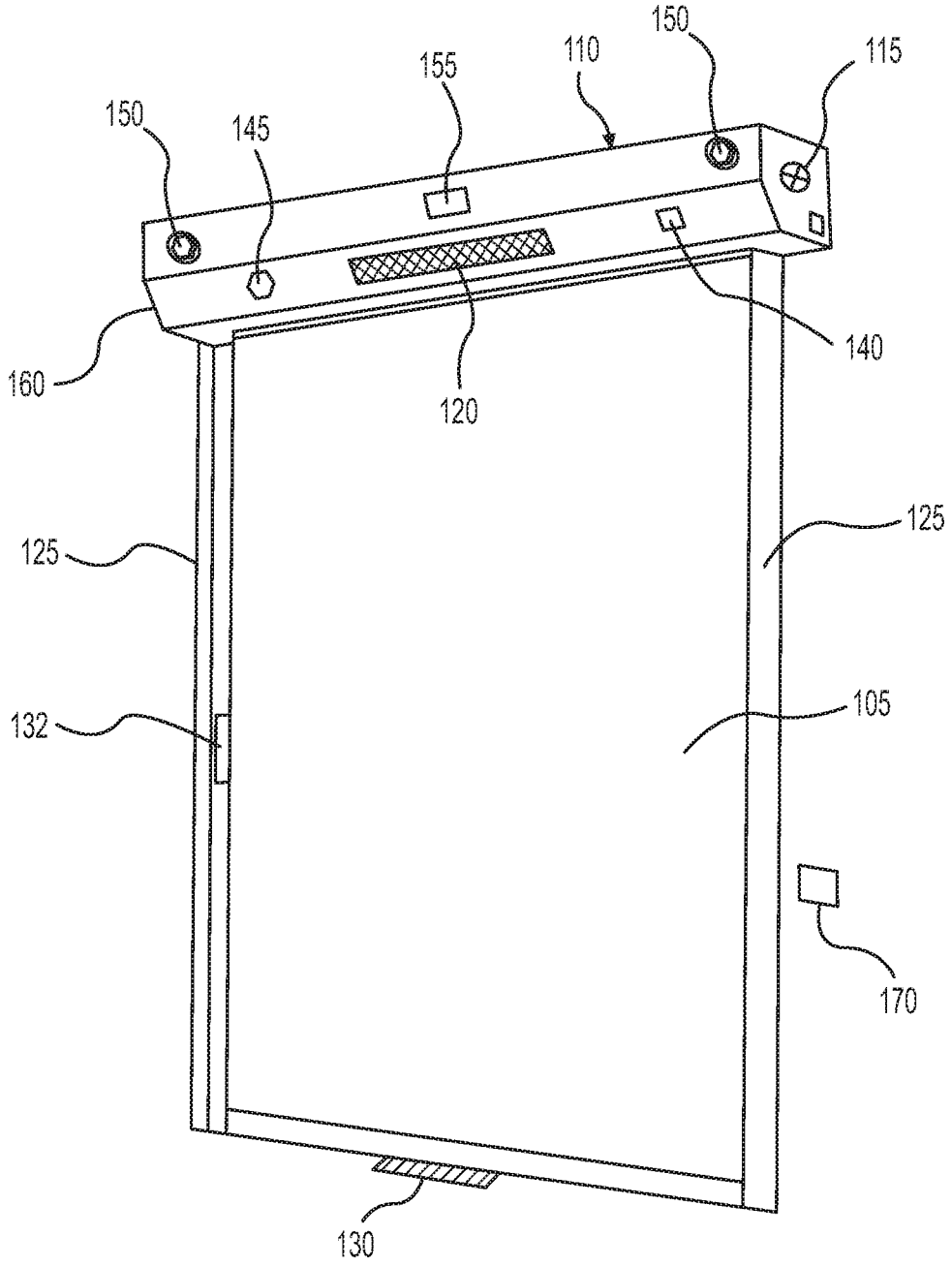
FIG. 1 is an example illustration of a shield system for disorienting and detaining an active shooter.

FIG. 1 is an example illustration of a shield system for disorienting and detaining an active shooter. In this example, a canopy 110 can be positioned above an opening and deploy a roll-up door 105. In this example, the roll-up door 105 is shown in a deployed position, blocking an opening behind the roll-up door 105. The roll-up door 105 can be motorized in an example. The motor can be electric and housed within the canopy 110. The canopy 110 can be connected to an electrical source, in an example. This can include hardwiring the canopy into an electrical system, such as in a ceiling above the canopy, in an example. In another example, a battery is enclosed inside the canopy 110. The battery can act as a backup power supply when the electrical source is not present, in an example.

The canopy 110 can include a controller that issues a signal to the motor to lower the roll-up door 105. The controller can be any type of processor. In one example, the controller receives sensor signals from the gunshot detection unit 155, fire detector, and from a wireless transceiver to determine when to deploy the roll-up door 105, siren 115, smoke machine 145, sprinkler 140, or LED 120. The wireless transceiver can be connected to a WIFI network in an example.

To reliably deploy the roll-up door 105, guide rails 125 can be placed on either side of the canopy 110. The guide rails 125 can form tracks from the canopy 110 down to the floor. The roll-up door 105 can slide down the guide rails 125 such that the roll-up door 105 deploys without leaving open gaps on the sides that a shooter could push through or fire through.

The shield system can lock the roll-up door 105 using an electromagnetic lock 130, 132, in an example. The electromagnetic lock 132 can be located within one of the rails 125 in example. This can cause a metal portion of the roll-up door 105 to become strongly attracted to the electromagnetic lock 132, preventing a person from lifting the door back up into the canopy 110. Alternatively, or in addition, an electromagnetic lock 130 can be positioned in the floor. When the door 105 is down, the electromagnetic lock 130 can attract a metal portion 134 of the door 110, preventing the door 110 from reopening.

A controller within the canopy 110 can cause the roll-up door 105 to deploy based on a deployment command, which is also referred to as a deployment condition. The deployment command can be detected by the controller based on a number of different conditional factors. The conditional factors can include a command received from a control station, an input at an authentication unit 170 (access control), or a combination of sensor inputs on the canopy itself. For example, a gunshot detection unit 155 can be included in the canopy 110. The gunshot detection unit 155 can classify a sound as a gunshot. The controller can interpret this classification as a deployment command and deploy the roll-up door 105.

The deployment command can also be transmitted from a command device, such as a cell phone, tablet, laptop, or specialized computing system. The command device can be any processor-enabled device that runs a command application that can communicate with one or more canopies 110. In one example, the command device can contact the canopy 110 over a local area network, such as a WIFI or ethernet network. Alternatively, the canopies 110 can talk to one another to transmit Bluetooth or other peer-to-peer communications in situations where WIFI is not available. This can allow a canopy 110 to receive a deployment command from a command device through other canopies passing the command until it reaches the canopy 110 with the correct ID.

The command application that runs on the command device can include a graphical user interface ("GUI") that allows a user, such as a school resource officer, to select which canopies to deploy or open. In one example, the GUI can show a floorplan, allowing the user to touch zones or specific doors within the floorplan. The user can then close multiple selected canopies to trap the shooter in a location, such as a hallway or foyer. The GUI can also display video feeds from the canopies 110. In one example, the GUI shows the location on the floorplan of the video feed being highlighted. This can allow the user to determine where in the floorplan the shooter is currently. By deploying a zone that includes the shooter, the canopies can all close their respective roll-up doors and trap the shooter, in an example.

Communications, such as deployment commands, between the command device and canopies 110 can be encrypted in an example. Canopies 110 can have unique IDs that are used to create a hash used for encrypting communications. The hash can also use an ID from the command device in an example. A timestamp can also be part of the hash, causing each command to be encrypted differently. This can prevent a hacker from intercepting a signal to a canopy 110 and using it to hijack control of other canopies.

The GUI can also be used to servile other safety aspects at the canopy 110. In one example, the guide rails 125 can act as sensors for a metal detector. For example, sensors can be embedded into the guide rails 125 and alert the command device when metal is detected. The GUI of the command device can then display the video from ten seconds before the metal detector was triggered, allowing the user to determine if a cause for alarm exists. The user can then operate a two-way speaker that includes a microphone. The GUI can have a button for activating the two-way speaker 160 remotely. The command device, which can be located in a control station, can allow the user to ask the person who set off the metal detector to open their bag or ask other questions. If needed, the GUI can be used to issue the deployment command. This can include closing the door 105 or simply activating disorientation features.

In one example, the GUI can display the floorplan of the structure that includes the shield system. The floorplan can include icons that represent locations of canopies 110. The floorplan can also be segregated into zones, allowing the user to control all canopies 110 within a zone at the same time. When a canopy 110 detects a gunshot, the detecting canopy 110 and/or zone in which it resides can be highlighted on the GUI. This can allow the user to quickly deploy canopies 110 in a zone where a threat exists, such as by selecting individual canopies 110 or the entire zone. This will also be explained in more detail later with regard to FIGS. 4 and 5.

The canopy 110 can also include various features for disorienting the shooter. For example, the canopy can include a siren 115. The siren 115 can issue a blaring noise at above 126 dB, in an example. The noise can be at least 90 dB in another example. Alternatively, a message can play at deafening levels. The siren 115 can be any type of siren or powered speaker, in an example.

The canopy 110 can also include an LED 120 that activates at either levels that are either distracting or even blindingly bright. For example, a minimum of 3000 lumens can be used. But in another example, flash pulses of up to 45000 lumens are used. The LED 120 can be one or more lights. In the example of FIG. 1, the LED 120 is a strip oriented parallel to a bottom of the canopy 110, slanted down to be directed into the shooter's field of vision.

The canopy 110 can further include sprinkler 140 for spraying water in the area. The sprinkler 140 can ensure that the shooter cannot light the immediate area on fire, in an example. The sprinkler 140 can be connected to a water reservoir within the canopy 110, in an example. Alternatively, plumbing can be provided to the canopy 110.

In one example, the sprinkler only activates if a fire is detected. The canopy 110 can include carbon monoxide detection in an example. In another example, a first canopy 110 can report carbon monoxide detection to the control device, which then can deploy sprinklers in a zone that the first canopy 110 resides in. The deployed sprinklers can be in other canopies 110 in the zone.

The canopy 110 can also include a smoke spraying machine 145 (also called a smoke sprinkler) that emits smoke or fog. The smoke can be created using prefabricated smoke cartridges, smoke power, or liquid fog droplets. In one example, the smoke spraying machine 145 can pump a glycol and water mixture across a heating element. The smoke can further limit the shooter's vision.

Other features of the canopy 110 can be used for tracking or negotiating with the shooter. For example, the canopy 110 can be equipped with multiple video cameras 150. This can allow authorities to see where the shooter is and what they are doing. In one example, a two-way speaker 160 can also allow the user to speak with the shooter and hear the shooter's response.

The command device can be used to deploy roll-up doors 105 at different areas (i.e., zones) of a building, such as a school. This can allow people to escape danger in some areas while locking down other areas where a shooter is present. In one example, the GUI on the command device can automatically display video feeds where gunfire is detected by a canopy 110. The user can then hit a button on the GUI to close a door 105 at the canopy 110. Another GUI selection can be used to close the nearest zone. The GUI can determine which canopy 110 doors 105 can be closed to contain the shooter in his current location. This button can therefore allow a user, such as a resource officer, to trap the shooter in a particular area of the building. This can drastically limit the harm from the shooter. The shooter can be contained, subjected to blaring noise and blinding light, until the authorities arrive, or the shooter takes their own life.

Different levels of deployment can be used to activate different features of the shield system. For example, if the gunshot detection unit 155 detects a single gunshot, the roll-up door 105 can close but various aural and visual deterrent features can remain inactive until a second indication is detected. In one example, the canopy 110 that detects the gunshot can provide its video feed to the command device. The GUI of the control application can maximize the video feed from the canopy 110 that makes the detection. The user can then see if a shooter is active or if there is some other reason for the loud gunshot-like noise, such as a physics experiment. If the shooter is present, the user can hit a large button presented on the GUI and the canopy 110 will deploy the various deterrents of the siren 115, smoke machine 145, sprinkler 140, and LED 120. Alternatively, a second gunshot detection can similarly deploy the siren 115, smoke machine 145, sprinkler 140, and LED 120.

In another example, after the roll-up door deploys, a gunshot detection can activate the siren 115, smoke 145, sprinkler 140, and LED 120. Therefore, if the command device sends a command to deploy the roll-up door 105, a subsequent gunshot detection can cause the canopy to deploy the siren 115, smoke machine 145, sprinkler 140, and LED 120.

The authentication unit 170 can be one or more of a card access point, thumbprint reader, retina scanner, manual key input, or a password pad. A user, such as a teacher, can deploy and re-open the roll-up door 105 using the authentication unit 170. For example, the user can scan a card, provide their thumbprint, or use their key to activate or deactivate deployment. The authentication unit 170 can be placed on the wall next to the roll-up door 105 in an example. Authenticating the user can change a deployment status of the canopy. For example, it can shut off the siren or cause the roll-up door to open.

A multi-stage deployment can help prevent undue alarm in some situations. However, in one example, a single deployment can activate all of the features of the shield system, including the siren 115, smoke machine 145, sprinkler 140, and LED 120.

In one example, activating the two-way speaker can momentarily disable the siren 115. This can allow a user to reliably converse with the shooter or with other people who are in the area.

An emergency release 136 can allow authorized users to release the electromagnetic lock 130, 132, in an example. The emergency release 136 can require a special key that a user, such as a resource officer or policeman, can have access to. Turning the emergency release 136 can cause a circuit to break between the electromagnetic lock and the power source.

Figure 2:
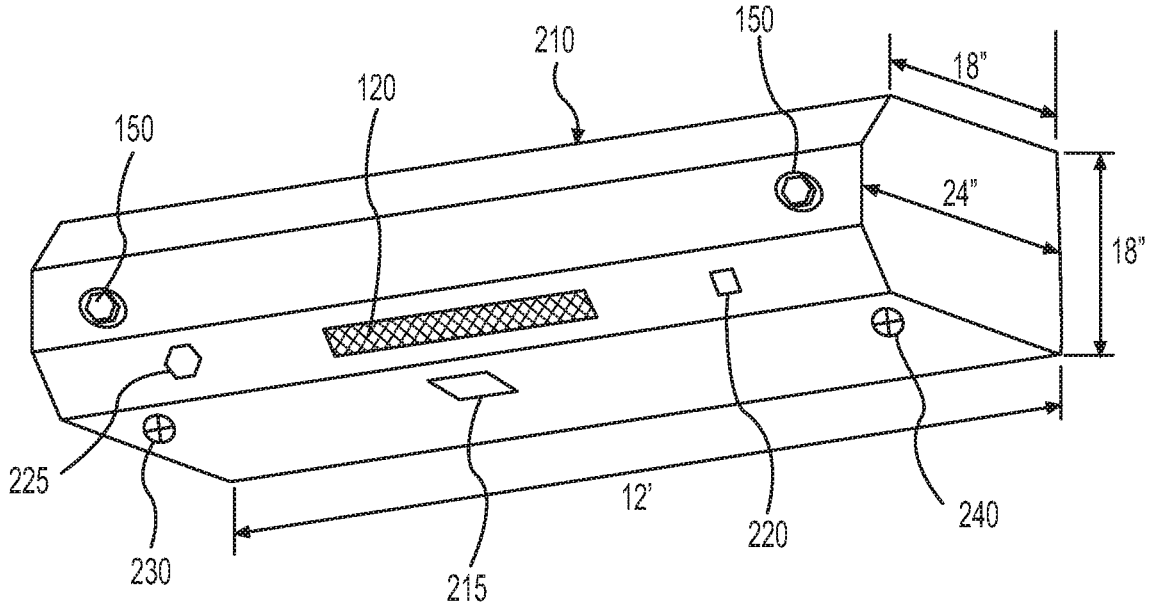
FIG. 2 is an example illustration of a shield system for disorienting an active shooter.

FIG. 2 is an example illustration of a shield system for disorienting an active shooter. In this example, the shield system 210 does not include a roll-up door. Instead, the canopy can be equipped with video cameras 150, LED 120, siren 215, smoke sprayer 225, sprinkler 220, two-way speaker 230, and gunshot detection unit 240. This can allow for providing the same features described with regard to FIG. 1, but without the door 105. In some situations, hanging a doorless shield system 210 above an opening still provides the surveillance and disorientation features without the need for an additional door.

The dimensions shown in FIG. 2 are exemplary, and other dimensions can apply. In FIG. 2, the shield system 210 is twelve feet wide, eighteen inches tall, and twenty-four inches deep. However, the shield system 210 can be sized according to the opening (e.g., entryway) that it is designed to be installed above. For example, it could be three feet wide to be placed over a door, or twelve feet wide to hang over the width of a hallway. Similarly, the dimensions of the canopy 110 of FIG. 1 can be selected based on where the shield system will be placed.

Figure 3:
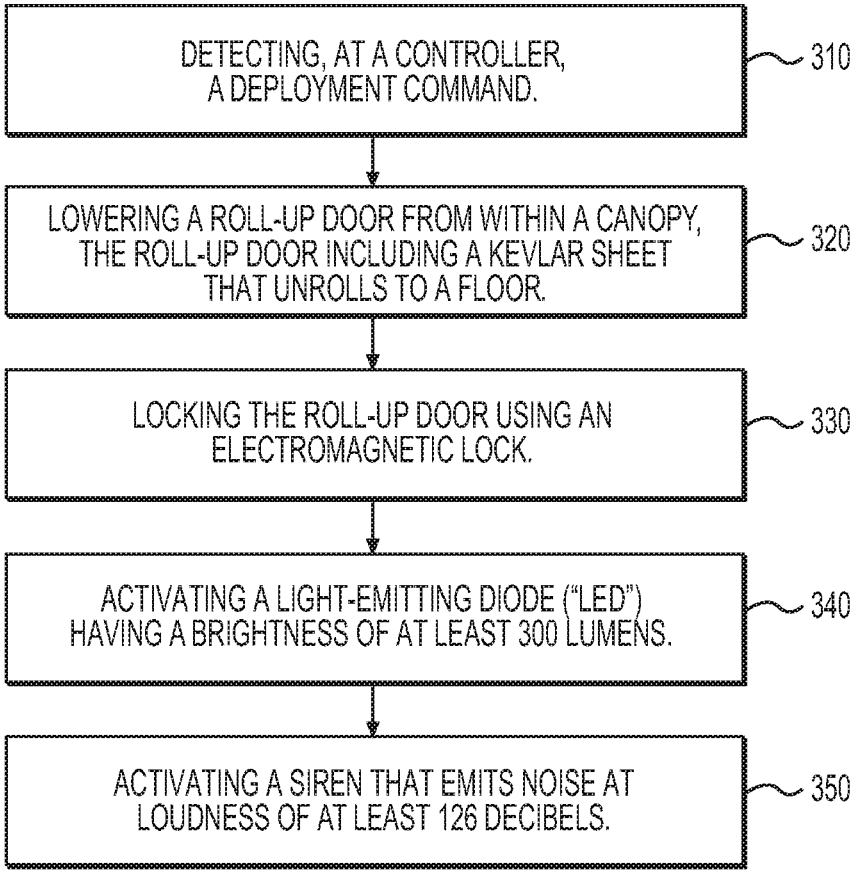
FIG. 3 is an example flowchart with stages performed by a shield system for disorienting and detaining an active shooter.

FIG. 3 is an example flowchart with stages performed by a shield system for disorienting and detaining an active shooter. The stages of FIG. 3 can be performed by a controller, which can be any type of processor. At stage 310, the controller can detect a deployment command. The controller can receive the deployment command over a network or can determine that conditions exist for a deployment command. As has been discussed, the deployment command can be sent from the command device or authentication unit 170. Alternatively, the deployment command can be a combination of sensor detections at the canopy 110 itself, such as a gunshot detection. In still another example, a gun can be spotted by artificial intelligence ("AI") that analyzes the video feed from the shield system 210 (e.g., canopy). The AI can be based on one or more models that are trained using machine learning. The AI can close the door, alert a user of the command device, or fully deploy the features of the shield system 210.

In response to the detection, at stage 320 the controller can lower the roll-up door. This can cause the roll-up door to emerge from the bottom of the canopy 110. The roll-up door can be a Kevlar sheet that then occludes the opening.

At stage 330, the controller can engage the electromagnetic lock. This can be delayed, allowing the roll-up door to fully close, in an example.

At stage 340, the controller can activate an LED having a brightness of at least 3000 lumens. As has been discussed, a much higher brightness, such as 10000 lumens, is also possible. The LED can pulse in an example to amplify blinding effect.

At stage 350, the controller can activate a siren that emits a noise at a loudness of at least 126 decibels. In one example, the siren can emulate the sound of gunfire so that the shooter believes someone is firing back at them. In another example, the siren can drone irritatingly. In still another example, the siren can play a message, warning the shooter of their imminent demise unless they drop their weapon and put their hands in the air.

Figure 4:
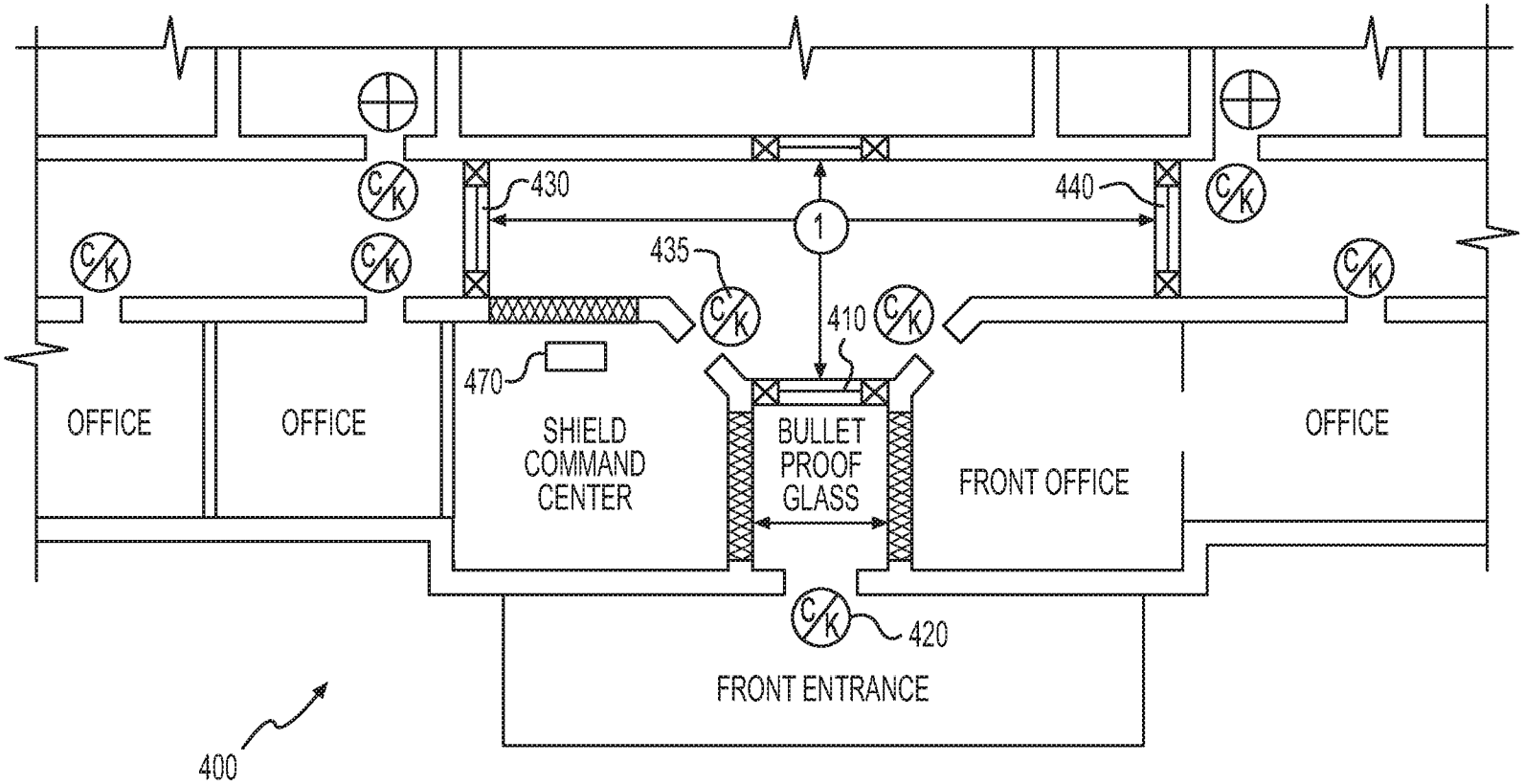
FIG. 4 is an example illustration of a building layout for detaining an active shooter using a shield system.

FIG. 4 is an example illustration of a building layout 400 for detaining an active shooter using a shield system. This layout 400 can be used as part of an office complex or a school, among other structures. In one example, the layout can display on the GUI of the command application. This can allow an authorized user to select individual canopies or zones of canopies to deploy. Additionally, the user can select video icons to see those particular video feeds. In one example, when the user sees the shooter on a video feed, the GUI can be used to deploy the zone that includes the source of the video feed. This can help the user more easily trap and disable the shooter.

The physical layout itself can be created to provide the user with tactical advantages over a shooter. In one example, a front entrance 420 can be monitored by attendees in the front office or shield command center. The entrance can feature bulletproof glass giving people in a front office and a shield command center visibility of the entrant.

In one example, a user can attempt to trap the shooter in a foyer (room 1) based on spotting the shooter in the entrance. For example, in this layout 400, the foyer is equipped with four shield canopies, including canopies 430, 435, 440. The user can use the command device 470 to close all the doors of the four shield canopies, including canopies 430, 435, 440. This can render the shooter trapped inside the foyer without any ability to escape.

Figure 5:
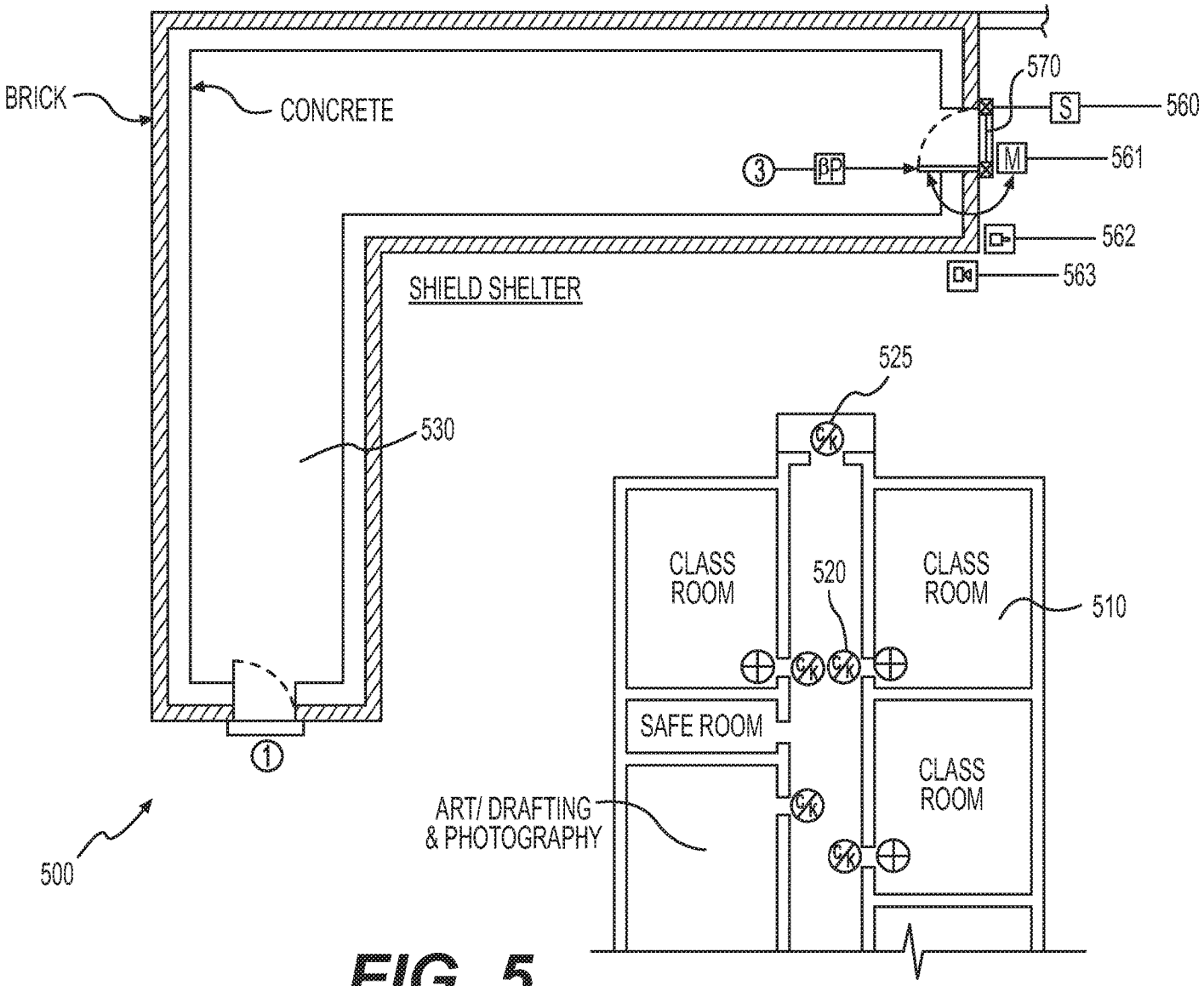
FIG. 5 is an example illustration of a building layout for detaining an active shooter using a shield system.

FIG. 5 is an example illustration of a building layout 500 for detaining an active shooter using a shield system. Again, the building layout 500 can display on the GUI of the command device, in an example. This can allow the user flexibility when deploying canopies or zones of canopies to trap or disorient a shooter. Additionally, the user can select video feeds to find the shooter or potential victims. This can allow the user to lock and unlock or close and open doors using the GUI, facilitating victim escape while impeding the shooter.

The physical layout 550 of this example is for school use. In one example, classrooms 510 can have a doorless shield canopy 520. Additionally, a second canopy 525 without a door can be used to disorient a shooter who enters or leaves the hallway.

Students and staff can escape into a safe room 530. The safe room 530 can include a third canopy 570 with a roll-up door. Once students and staff are inside, the door can be closed to prevent the shooter from any access to these would-be victims. Additionally, the door can be reopened remotely based on video feeds from video cameras 562, 563. Individuals fleeing the chaos can use a two-way speaker 560 to communicate with the command center or an authentication unit 561 can be used to scan the door open or closed.

In one example, a drone sits atop the safe room 530. When the deployment command is issued from the command device, it can also cause the drone to take flight. The drone can then circle the school on a pre-programmed flight path. The flight path can be designed to monitor school perimeter or saferoom perimeter, depending on the example. In one example, multiple drones at multiple locations can be activated by the deployment command and being sending video feeds to the command device.

In another example, the drone can be located inside the structure. Upon deployment it can begin roaming the halls and transmitting video. In one example, using the GUI of the command device, a user can select an individual in the video feed. This can cause the drone to follow that individual. The drone can also appear as a dot on the floorplan within the GUI in an example. This can ensure that the user gains the benefit of location context in relation to the drone.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A system for shielding people from an active shooter, comprising:

a canopy that hangs over an opening, wherein the canopy includes:

a light-emitting diode ("LED") having a brightness of at least 3000 lumens; and a siren that emits noise at a loudness of at least 126 decibels;

a roll-up door that deploys from the canopy, the roll-up door including a Kevlar sheet that unrolls upon deployment;

an electromagnetic lock that prevents the deployed roll-up door from opening; and a controller that, in response to a deployment command:

deploys the roll-up door;

activates the LED;

activates the siren; and activates the electromagnetic lock.

2. The system of claim 1, wherein the electromagnetic lock is placed in a floor below the canopy and, upon activation, causes magnetic attraction with a metal on a portion of the deployed roll-up door that contacts the floor.

3. The system of claim 1, wherein the electromagnetic lock is located on at least one guide rail of the roll-up door.

4. The system of claim 1, wherein the LED is a strip oriented parallel to a bottom of the canopy.

5. The system of claim 1, wherein the canopy includes a two-way speaker that includes a microphone, wherein the two-way speaker can be controlled remotely from a control station, wherein the control station also issues the deployment command.

6. The system of claim 1, further comprising a gunshot detection unit, wherein the controller is configured to treat a detection at the gunshot detection unit as a deployment command.

7. The system of claim 1, further comprising a battery backup that causes the electromagnetic lock to remain in place when alternating current at the electromagnetic lock is lost.

8. The system of claim 1, wherein the deployment command causes a drone to take flight and start transmitting video.

9. The system of claim 8, wherein the deployed drone flies on a programmed flight path that is specific to the building.

10. The system of claim 1, further comprising a second canopy that is installed over an exit for an area, wherein the deployment command causes roll-up doors in at least the canopy and the second canopy to deploy, closing off an area.

11. The system of claim 1, wherein the canopy includes a smoke sprinkler assembly that sprays smoke in response to the deployment command.

12. The system of claim 1, wherein the canopy includes a sprinkler assembly that sprays water in response to the deployment command.

13. The system of claim 1, further comprising executing a control application on a control device, the control application causing the control device to display a graphical user interface ("GUI"), wherein the GUI includes a feature that can be set to issue the deployment command to a first area of multiple areas of a building, wherein the first area includes the canopy among a subset of canopies that exist in the building.

14. The system of claim 13, wherein the GUI includes a camera feed that displays video from the canopy, wherein the video is prioritized over video from other canopies based on gunshot detection at the canopy.

15. The system of claim 1, further comprising an access control that authenticates a user based on at least one of retinal detection, fingerprint detection, card access, hard key access, and password detection on a keypad, wherein the authentication changes a deployment status of the canopy.

16. The system of claim 1, further comprising guides for the roll-up door, wherein the guides house metal detector sensors that perform a metal detector function.

17. A method for shielding individuals and neutralizing gunmen, comprising:

detecting, at a controller, a deployment command;

in response to the deployment command, performing deployment functions including:

lowering a roll-up door from within a canopy, the roll-up door including a bullet-resistant and fire-resistant Kevlar sheet that unrolls and closes by following guide rails;

locking the roll-up door using an electromagnetic lock;

activating a light-emitting diode ("LED") having a brightness of at least 3000 lumens; and activating a siren that emits noise at a loudness of at least 126 decibels.

18. The method of claim 17, wherein the deployment command is issued from a command device, and wherein the deployment command is sent to a subset of canopies within a building based on the subset of canopies corresponding to a zone.

19. The method of claim 18, wherein locking the roll-up door includes powering the electromagnetic lock, the electromagnetic lock being embedding in a floor below the canopy.

* * * * *